US007231740B2

(12) United States Patent
Jirele

(10) Patent No.: US 7,231,740 B2
(45) **Date of Patent: *Jun. 19, 2007**

(54) MODULAR STAGE PROP

(75) Inventor: Scott E. Jirele, Owatonna, MN (US)

(73) Assignee: Wenger Corporation, Owatonna, MN (US)

( * ) Notice: Subject to any disclaimer, the term of this patent is extended or adjusted under 35 U.S.C. 154(b) by 24 days.

This patent is subject to a terminal disclaimer.

(21) Appl. No.: 10/804,931

(22) Filed: Mar. 19, 2004

(65) Prior Publication Data

US 2004/0221517 A1 Nov. 11, 2004

Related U.S. Application Data

(60) Provisional application No. 60/455,975, filed on Mar. 19, 2003.

(51) Int. Cl.
*E04H 3/28* (2006.01)

(52) U.S. Cl. ..... 52/7; 52/64; 108/11; 108/13; 108/53.1; 108/53.5; 108/54.1; 108/92

(58) Field of Classification Search ..... 52/596–612, 52/7, 9, 64, 67, 143, 795.1, 270, 284; 446/85, 446/108, 116, 120, 121, 124, 127–128; 108/92, 108/95–98, 64, 53.5, 11, 13, 91, 53.1, 53.3, 108/54.1

See application file for complete search history.

(56) References Cited

U.S. PATENT DOCUMENTS 3,035,671 A 5/1962 Sicherman
3,331,529 A * 7/1967 Slapnik ..... 206/508
3,568,877 A * 3/1971 Mastrud, Jr. ..... 229/122
3,680,735 A 8/1972 Lucas
4,022,461 A 5/1977 Harris
4,339,047 A 7/1982 Johansson et al.
4,405,057 A 9/1983 Stein
4,523,512 A * 6/1985 Hessel et al. ..... 91/168

(Continued)

FOREIGN PATENT DOCUMENTS

EP 0073357 A2 3/1983

(Continued)

*Primary Examiner*—Jeanette Chapman
(74) *Attorney, Agent, or Firm*—Patterson, Thuente, Skaar & Christensen, P.A.

(57) ABSTRACT

A modular stage prop system having a first stage prop and a second stage prop. The first stage prop has a first stepping surface and a plurality of first side surfaces extending from the first stepping surface. The first stepping surface and the plurality of first side surfaces define a first partial enclosure in which an object may be stored. At least one of the first stepping surface and the plurality of first side surfaces has a male connector portion. The second stage prop has a second stepping surface and a plurality of second side surfaces extending from the second stepping surface. The second stepping surface and the plurality of second side surfaces define a second partial enclosure in which an object may be stored. At least one of the second stepping surface and the plurality of second side surfaces has a female connector portion. The male connector portion and the female connector portion are capable of engaging each other for retaining the first stage prop and the second stage prop in a stationary relationship with respect to each other.

4 Claims, 6 Drawing Sheets

U.S. PATENT DOCUMENTS 4,538,394 A * 9/1985 Farnum ..... 52/664
4,550,832 A 11/1985 Traumuller et al.
4,580,776 A * 4/1986 Burkinshaw ..... 52/7
4,582,219 A 4/1986 Mortensen et al.
4,709,834 A 12/1987 Mortensen et al.
5,042,674 A 8/1991 Ramsay et al.
5,050,861 A 9/1991 Thomas et al.
5,107,653 A * 4/1992 Lewis ..... 52/591.1
5,154,656 A * 10/1992 Milstein ..... 446/120
5,176,596 A * 1/1993 Ullman ..... 482/52
5,184,726 A 2/1993 Box
5,343,817 A * 9/1994 Abraham et al. ..... 108/97
5,357,876 A 10/1994 Kniefel et al.
5,466,058 A * 11/1995 Chan ..... 312/111
5,531,352 A * 7/1996 Kraft et al. ..... 220/675
5,535,941 A 7/1996 Garza
5,673,848 A 10/1997 Garza
5,860,527 A 1/1999 Frankenberg et al.
5,924,906 A * 7/1999 Grafton ..... 446/121
6,050,044 A * 4/2000 McIntosh ..... 52/591.1
6,193,340 B1 * 2/2001 Schenker et al. ..... 312/265.5
6,202,886 B1 * 3/2001 Schneider et al. ..... 220/645
6,367,631 B1 4/2002 Steigerwald
6,386,365 B1 5/2002 Tan
D459,888 S 7/2002 Elvin-Jensen et al.
6,511,073 B2 * 1/2003 Simonds ..... 273/299
6,648,715 B2 * 11/2003 Wiens et al. ..... 446/121
D502,022 S * 2/2005 Jirele ..... D6/396
2003/0136781 A1 7/2003 Rumpel

FOREIGN PATENT DOCUMENTS

EP 0197162 A1 10/1986
EP 0197162 B1 1/1989
EP 0429062 A1 5/1991
EP 0564029 A1 10/1993
EP 0518402 B1 9/1995
EP 0564029 B1 3/1996
EP 1253088 A1 10/2002
WO WO02079043 A3 10/2002
WO WO02094665 A1 11/2002
WO WO03039979 A1 5/2003

* cited by examiner

MODULAR STAGE PROP

REFERENCE TO RELATED APPLICATION

The present application claims priority to U.S. Provisional Application No. 60/455,975, filed Mar. 19, 2003. The identified provisional application is hereby incorporated by reference in their entirety.

FIELD OF THE INVENTION

The present invention relates generally to equipment for the performing arts. More particularly, the present invention relates to a modular stage prop particularly adapted for live theatre rehearsal sets.

BACKGROUND OF THE INVENTION

Those involved in the performing arts often need props for rehearsal sets. For example, simple boxes are often used as a bed, table, stairway, chair, couch, desk, or countertop to provide a reference point on the stage for the actors and stage crew. Multiple boxes are often stacked, aligned, and positioned so that they take on the general appearance of the desired objects. These configurations must be done and undone quickly, sometimes in a matter of minutes. In addition, the boxes are often used as platforms on which the actors and actresses stand, sit, dance, and jump. Because of this, the boxes must be able to support a large amount of weight.

Those involved in the performing arts also need boxes to carry equipment to and from the stage, dressing rooms, and storage. Therefore, the boxes that can be lifted and transported easily and quickly by one person can serve a dual purpose.

Conventional boxes used on rehearsal sets are often handmade or made-to-order plywood boxes, which are heavy, clumsy, and difficult to carry, move, and arrange. Furthermore, those using plywood boxes do not have any methods to connect the boxes and arrange them into shapes with the general appearance of a bed, table, stairway, chair, couch, desk, countertop, etc. In addition, the plywood boxes are also large and take up a lot of space in dressing rooms and in storage areas. A lightweight, sturdy box that can readily be coupled to like boxes to form a variety of shapes, and which could also provide service as a readily transportable container, would provide decided advantages.

SUMMARY OF THE INVENTION

The present invention is directed to a modular stage prop system having a first stage prop and a second stage prop. The first stage prop includes a first stepping surface and a plurality of first side surfaces extending from the first stepping surface. The first stepping surface and the plurality of first side surfaces define a first partial enclosure in which an object may be stored. At least one of the first stepping surface and the plurality of first side surfaces has a male connector portion.

The second stage prop includes a second stepping surface and a plurality of second side surfaces extending from the second stepping surface. The second stepping surface and the plurality of second side surfaces define a second partial enclosure in which an object may be stored. At least one of the second stepping surface and the plurality of second side surfaces has a female connector portion. The male connector portion and the female connector portion are capable of engaging each other for retaining the first stage prop and the second stage prop in a stationary relationship with respect to each other.

DETAILED DESCRIPTION OF THE DRAWINGS

Figure 1:
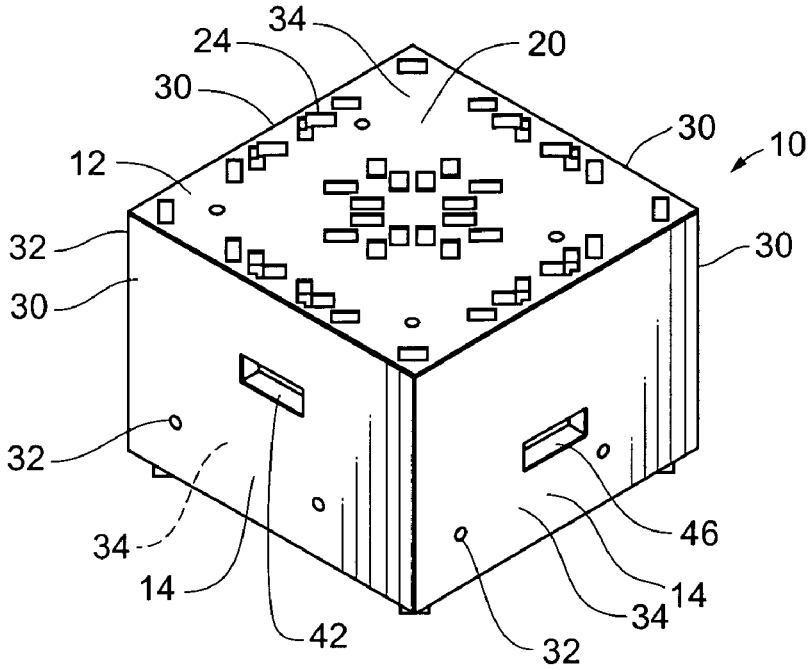
FIG. 1 is a top perspective view of a modular stage prop in accordance with the present invention.
Figure 2:
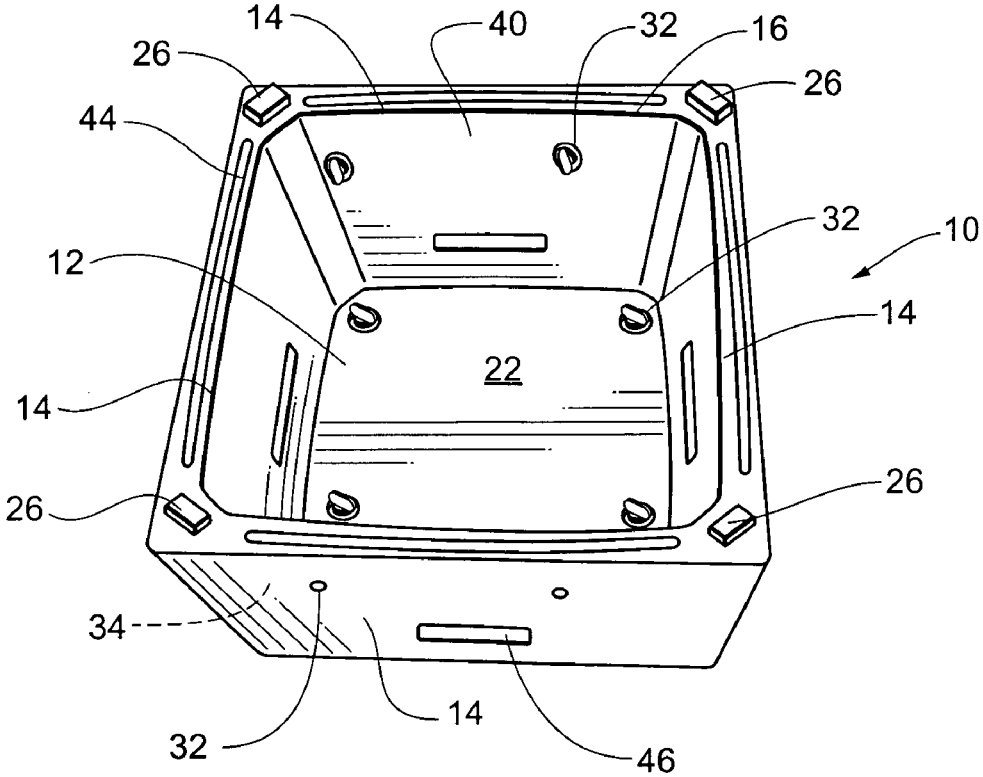
FIG. 2 is a bottom perspective view of the modular stage prop.

A modular stage prop 10 according to the present invention generally includes a stepping surface 12 and a plurality of side surfaces 14 that extend from the stepping surface 12, as illustrated in FIGS. 1–2.

In a first orientation (FIG. 1), the modular stage prop 10 provides an elevated surface on which a person can stand, sit or place objects. In a second orientation (FIG. 2), the modular stage prop 10 provides a partially enclosed region 16 in which objects may be stored.

The stepping surface 12 has an outer wall 20 and an inner wall 22. The outer wall 20 has a plurality of recesses 24 formed therein that are each adapted to receive a foot 26 that extends from the side surfaces 14, as is discussed in more detail below.

The recesses 24 are preferably placed at a variety of locations along edges 30 of the stepping surface 12 as well as proximate a center of the stepping surface 12 to facilitate stacking the modular stage props 10 in a variety of configurations.

The recesses 24 each preferably have a substantially similar rectangular shape that is slightly larger than the foot 26 so that each recess can receive one of the feet 26 while restricting lateral movement of the foot 26 in the recess 24. The recesses 24 are each oriented at an angle of about 45° with respect to one of the edges 30 of the stepping surface 12.

The stepping surface 12 preferably includes a locking mechanism having at least one male connector portion 32 and at least one female connector portion 34 to facilitate attaching multiple modular stage props 10 to each other.

The side surfaces 14 are each preferably substantially flat and include an inner wall 40, an outer wall 42, and an end wall 44. Each of the side surfaces 14 preferably includes a handle 44 that facilitates lifting the modular stage prop 10.

While the handle 46 may have a variety of configurations, the handle 46 preferably is formed by an aperture that extends from the inner wall 40 to the outer wall 42.

Similar to the stepping surface 12, each of the side surfaces 14 preferably includes at least one male connector 32 and at least one female connector 34 for attaching multiple modular stage props 10 together. The male and female connector portions 32, 34 on stepping surface 12 and the side surfaces 14 are preferably substantially similar to facilitate interconnection of the components in a variety of configurations.

The feet 26 preferably extend from the end wall 44, which is oriented opposite the stepping surface 12. The feet 26 may be integrally molded with the stepping surface 12 and the side surfaces 14 or the feet 26 may be formed separately from the other portions of the modular stage prop 10. Forming the feet 26 separately from the other portions of the modular stage prop 10 enables the feet to be formed from a material that provides enhanced durability.

The feet 26 support the end wall 44 above a ground surface when the modular stage prop 10 is in the first configuration to prevent abrasion of the end wall 44 when the modular stage prop 10 slides along the ground surface. The feet 26 also assist with stacking of the modular stage props 10 by extending into the recesses 24.

Figure 3:
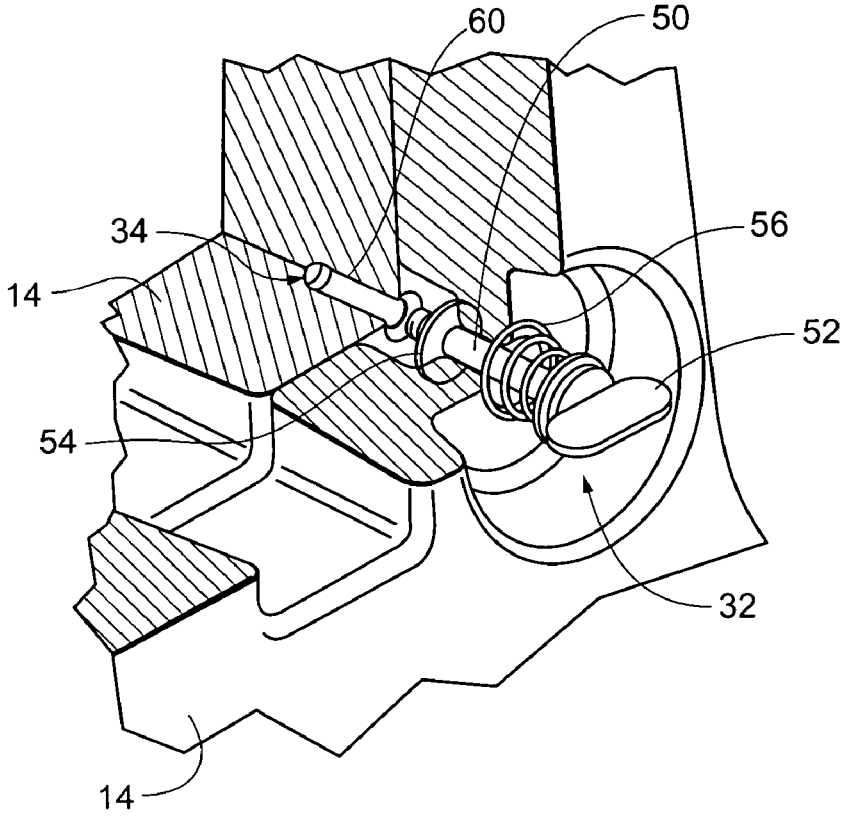
FIG. 3 is a partially broken away view of the modular stage prop illustrating a locking mechanism.

As most clearly illustrated in FIG. 3, the male connector portion 32 preferably includes a threaded shaft 50, a handle 52, a washer 54 and a spring 56. The configuration of the male connector portion 32 preferably enables the male connector portion 32 to be operated manually without the use of tools.

The handle 52 is located opposite the threaded shaft 50 to facilitate rotation of the threaded shaft 50 for engaging the female connector portion 34, which is a recess with a threaded surface 60.

The washer 54 engages the threaded shaft 50 opposite the handle 52 and thereby prevents the male connector portion 32 from being separated from the stepping surface 12 or the side surface 14 to which it is attached to thereby reduce the potential of the male connector portion 32 from being lost.

The male connector portion 32 is movable between a retracted position and an extended position. The spring 56 biases the male connector portion 32 to the retracted position while enabling the male connector portion 32 to be moved to the extended position for engaging the female connector portion 34 with manual force.

When the male connector portion 32 is in the retracted position, the male connector portion 32 is substantially between the inner and outer walls of the stepping surface 12 or the side surface 14 to which it is attached. This configuration reduces the potential of damage to the male connector portion 32 during movement of the modular stage prop 10.

The modular stage prop 10 is preferably fabricated using injection molding. A person of ordinary skill in the art will appreciate that the modular stage prop 10 may be fabricated from a variety of materials. Outer surfaces of the modular stage prop 10 are preferably textured to enhance traction when person walk or otherwise move over the modular stage prop 10.

Figure 4:
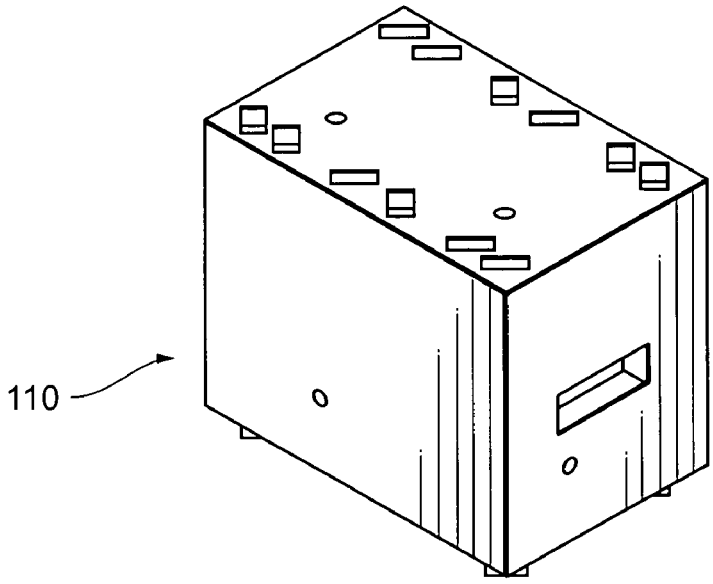
FIG. 4 is a top perspective view of another modular stage prop.
Figure 5:
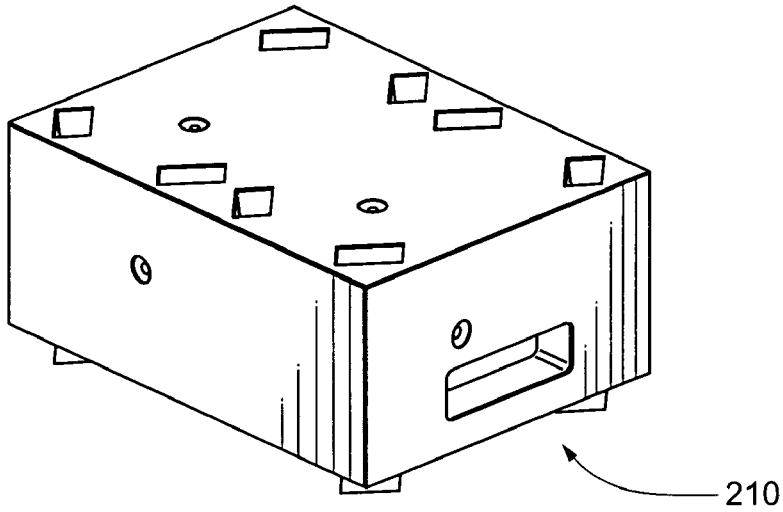
FIG. 5 is a top perspective view of still another modular stage prop.

The modular stage prop 10 is preferably formed in a variety of sizes to facilitate forming stage props having a variety of shapes and to facilitate storing objects having various sizes. The modular stage prop is preferably available in three sizes: large, medium and small The large modular stage prop 10, which is illustrated in FIG. 1, preferably has a height of about 18 inches, a length of about 24 inches and a width of about 24 inches. The medium modular stage prop 110, which is illustrated in FIG. 4, preferably has a height of about 16 inches, a length of about 18 inches and a width of about 12 inches. The small modular stage prop 210, which is illustrated in FIG. 5, preferably has a height of about 8 inches, a length of about 16 inches and a width of about 12 inches.

Figure 6:
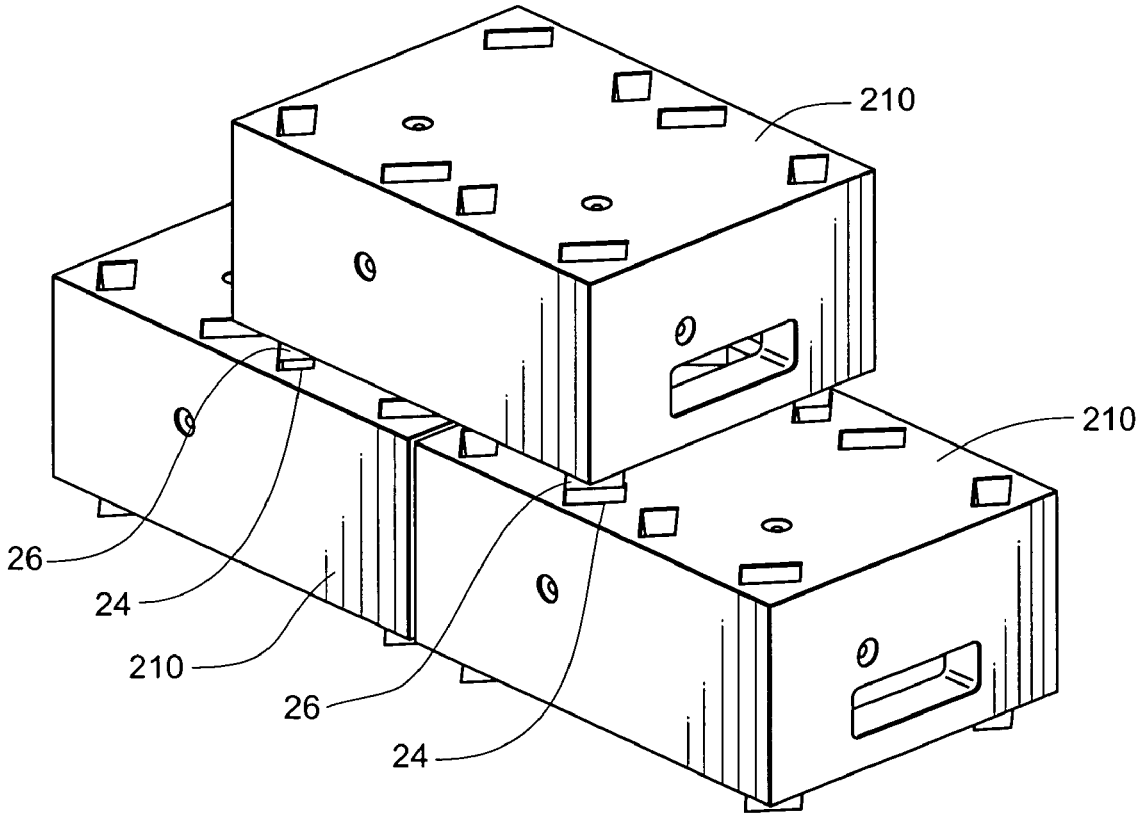
FIG. 6 is a perspective view illustrating stacking of a plurality of modular stage props.

The small modular stage props 210 may be stacked in an offset configuration, as illustrated in FIG. 6, where the feet 26 on an upper level small modular stage prop 210 extend into recesses 24 on two lower level small modular stage props 210.

Figure 7:
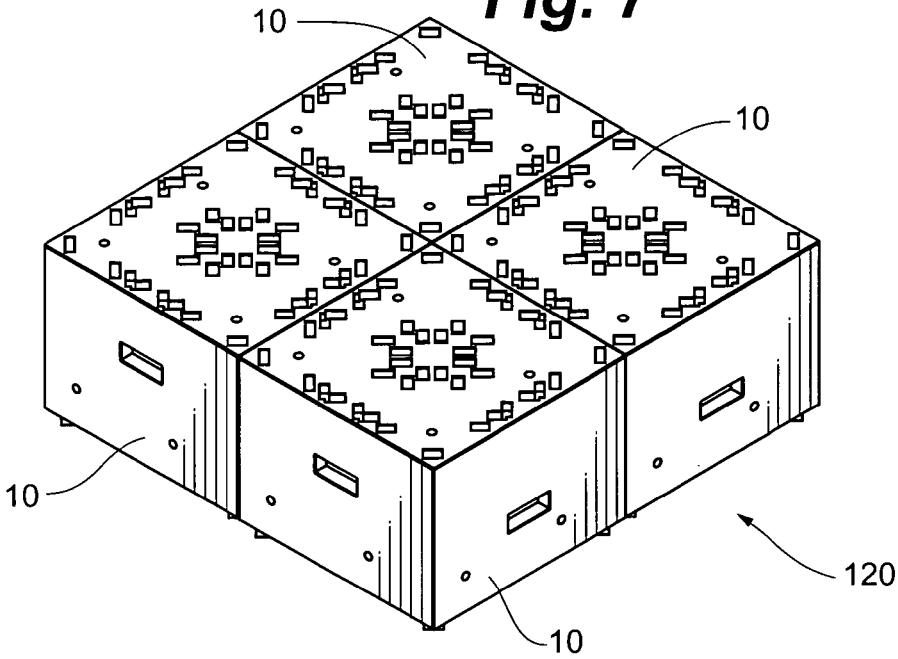
FIG. 7 is a perspective view illustrating configuring a plurality of modular stage props to form a platform.

In another configuration, four large modular stage props 10 may be placed adjacent to each other in a square configuration to form a platform 120, as illustrated in FIG. 7. To prevent the individual large modular stage props 10 from moving with respect to each other, the large modular stage props 10 are preferably attached to each other using the locking mechanism.

Figure 8:
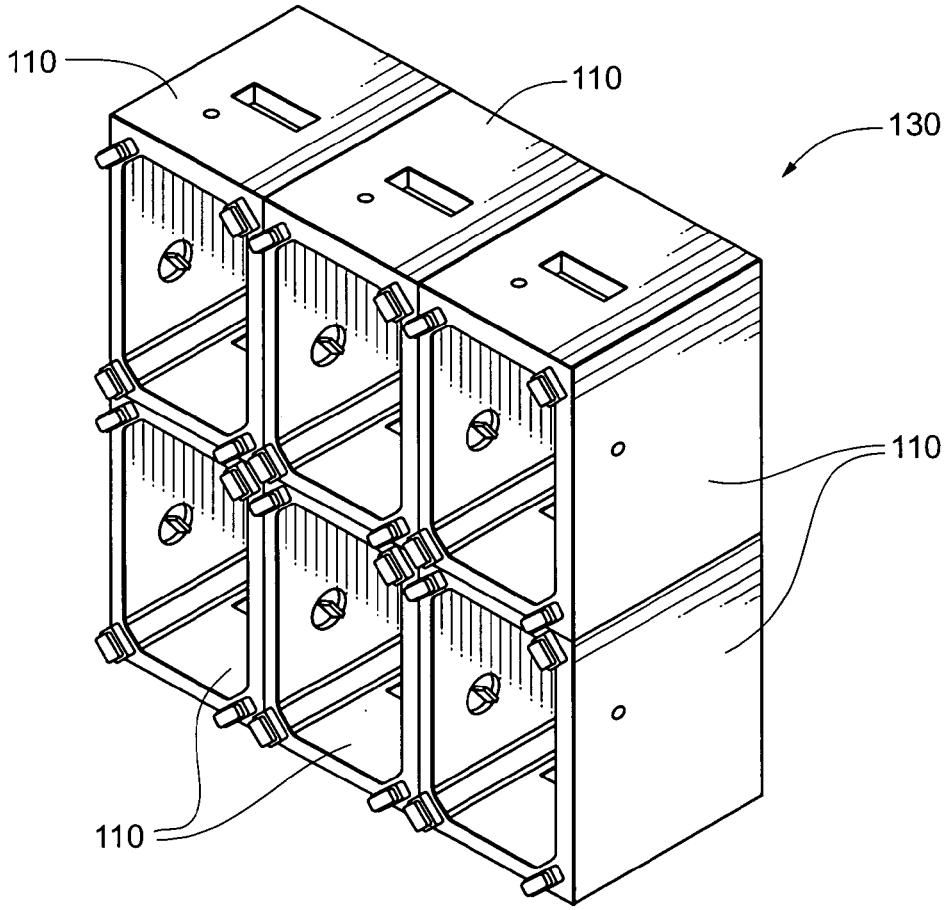
FIG. 8 is a perspective view illustrating configuring a plurality of modular stage props to form a counter

A counter 130 may be formed by orienting six medium modular stage props 110 on side surfaces 14 and then arranging them in an array, as illustrated in FIG. 8. To prevent the individual medium modular stage props 110 from moving with respect to each other, the medium modular stage props 110 are preferably attached to each other using the locking mechanism.

Figure 9:
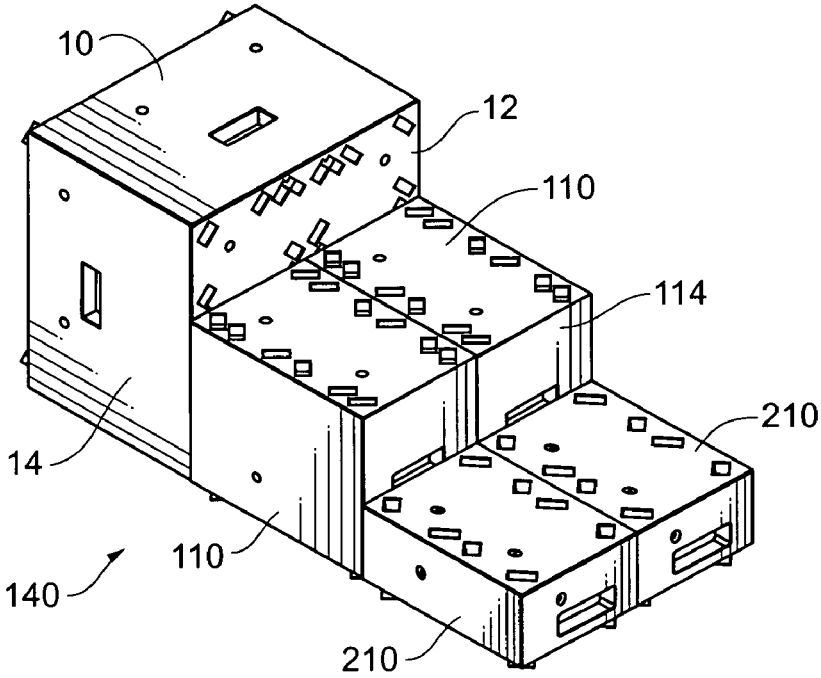
FIG. 9 is a perspective view illustrating configuring a plurality of modular stage props to form stairs.

Combining different size modular stage props greatly enhances the variety of objects that may be formed using the modular stage props. As illustrated in FIG. 9, Stairs 140 may be formed by orienting the large modular stage prop 10 on the side surface 14. Two medium modular stage props 110 are placed adjacent to each other and adjacent the stepping surface 12 on the large modular stage prop 10.

Two small modular stage props 210 are placed adjacent each other and adjacent the side surfaces 114 of the medium modular stage props 110. The large, medium and small modular stage props 10, 110, 210 are preferably connected to each other to prevent them from moving with respect to each other.

Figure 10:
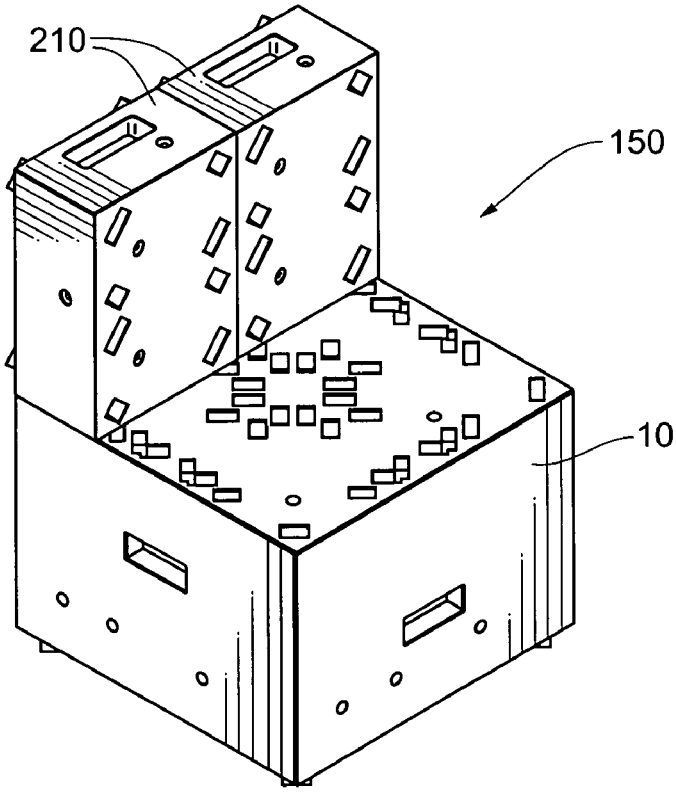
FIG. 10 is perspective view illustrating configuring a plurality of modular stage props to form a chair.
Figure 11:
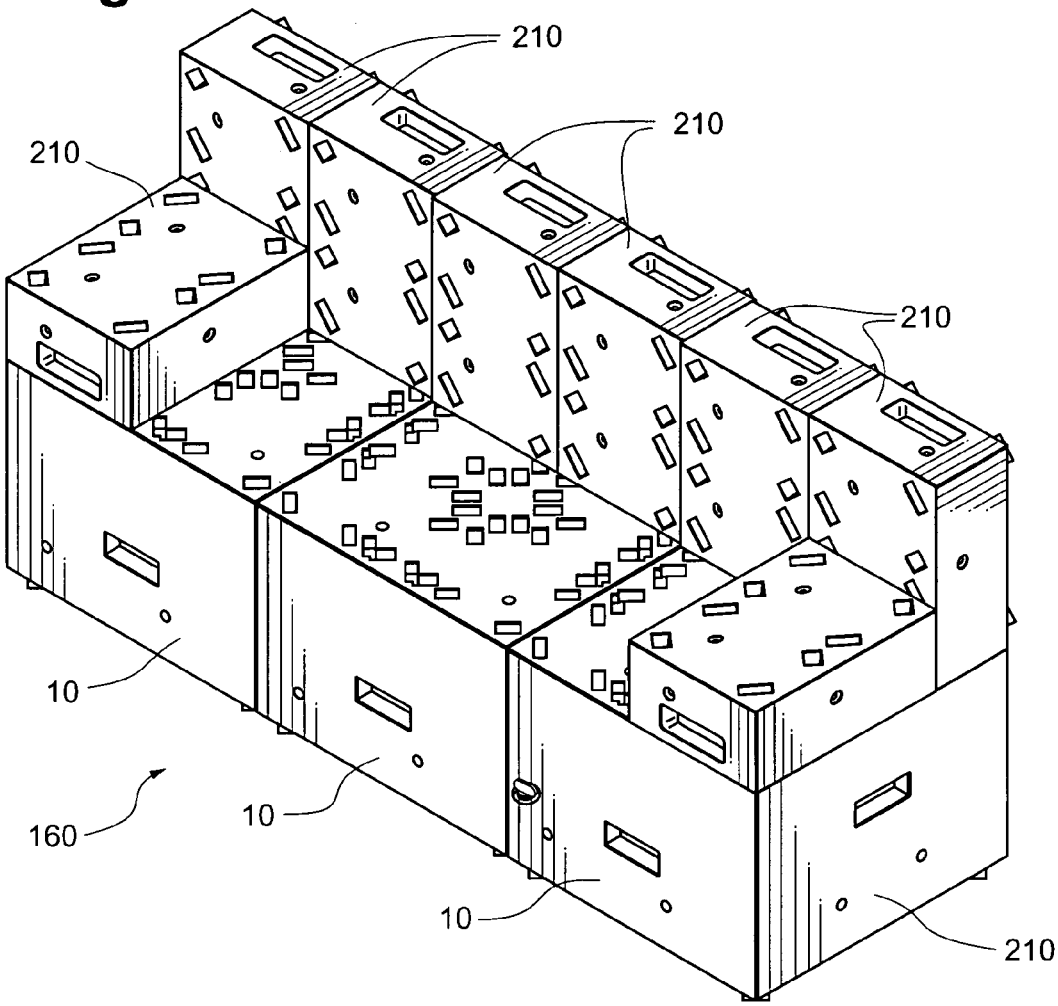
FIG. 11 is a perspective view illustrating configuring a plurality of modular stage props to form a couch.

It is also possible to form a chair 150 (FIG. 10) and a couch 160 (FIG. 11) may also be formed by selectively connecting the large modular stage props 10 and the small modular stage props 210. Similar to the other objects formed from the modular stage props, the items used to fabricate the chair 150 and the couch 160 are preferably connected to each other. By connecting the modular stage props together, the potential of injury caused by leaning against a movable stage prop is reduced.

Figure 12:
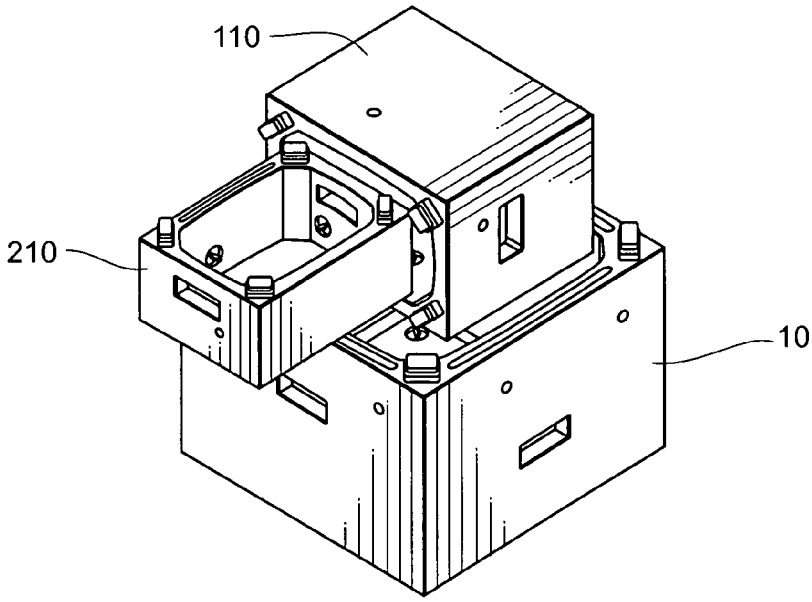
FIG. 12 is a perspective view of a plurality of modular stage props in a partially nested configuration.

Another advantage of the modular stage props of the present invention is that the modular stage props may be nested to facilitate more dense storage, as illustrated in FIG. 12. As an initial step in nesting, the small modular stage prop 210 is placed inside of the medium stage prop 110. The medium stage prop 110 is then placed inside of the large modular stage prop 10.

The present invention may be embodied in other specific forms without departing from the spirit or essential attributes thereof, and it is, therefore, desired that the present embodiment be considered in all respects as illustrative and not restrictive. Further, alternative methods, apparatus, and techniques of fastening, attaching, shaping, and forming structures and components of the present invention are envisioned.

The invention claimed is:

1. A modular stage prop system comprising:

a first stage prop that comprises a first stepping surface and a plurality of first side surfaces extending from the first stepping surface and having a proximal end adjacent to the first stepping surface and a distal end opposite the first stepping surface, wherein the first stepping surface and the plurality of first side surfaces define a first partial enclosure in which an object may be stored, and wherein at least one of the plurality of first side surfaces of said first stage prop has a first locking member; and a second stage prop that comprises a second stepping surface and a plurality of second side surfaces extending from the second stepping surface and having a proximal end adjacent to the second stepping surface and a distal end opposite the second stepping surface, wherein the second stepping surface and the plurality of second side surfaces define a second partial enclosure in which an object may be stored, wherein at least one of second side surfaces of said second stage prop has a second locking member, and wherein the first and second locking members are located at the same distances from the distal ends of the first and second side surfaces, respectively, such that when the first and second side surfaces are proximate each other, the first locking member is capable of engaging the second locking member sideways thereby retaining the first stage prop and the second stage prop in a stationary relationship with respect to each other.

2. A modular stage prop system comprising: a first stage prop that comprises a first stepping surface and a plurality of first side surfaces extending from the first stepping surface, wherein the first stepping surface and the plurality of first side surfaces define a first partial enclosure in which an object may be stored, and wherein at least one of the first stepping surface and the plurality of first side surfaces has a male connector portion; and a second stage prop that comprises a second stepping surface and a plurality of second side surfaces extending from the second stepping surface, wherein the second stepping surface and the plurality of second side surfaces define a second partial enclosure in which an object may be stored, wherein at least one of the second stepping surface and the plurality of second side surfaces has a female connector portion, and wherein the male connector portion and the female connector portion are capable of engaging each other for retaining the first stage prop and the second stage prop in a stationary relationship with respect to each other, and wherein the male connector portion is movable between an extended position and a retracted position, and wherein the male connector portion is biased to the retracted position.

3. A modular stage prop system comprising: a first stage prop that comprises a first stepping surface and a plurality of first side surfaces extending from the first stepping surface, wherein the first stepping surface and the plurality of first side surfaces define a first partial enclosure in which an object may be stored, and wherein at least one of the first stepping surface and the plurality of first side surfaces has a first locking member; and a second stage prop that comprises a second stepping surface and a plurality of second side surfaces extending from the second stepping surface, wherein the second stepping surface and the plurality of second side surfaces define a second partial enclosure in which an object may be stored, wherein at least one of the second stepping surface and the plurality of second side surfaces has a second locking member, and wherein the first locking member and the second locking member are capable of engaging each other for retaining the first stage prop and the second stage prop in a stationary relationship with respect to each other, and wherein the first looking member is movable between an extended position and a retracted position, and wherein the first locking member is biased to the retracted position.

4. The modular stage prop system of claim 3, wherein the first stepping surface and the plurality of first side surfaces each have an inner wall and an outer wall that are oriented in a spaced-apart configuration, and wherein the first locking member is biased substantially between the inner wall and the outer wall when the first locking member is in the retracted position.

* * * * *